US005467872A

United States Patent [19]

Minarelli et al.

[11] Patent Number: 5,467,872

[45] Date of Patent: Nov. 21, 1995

[54] RIGID HINGED-LID PACKET FOR TOBACCO PRODUCTS, PARTICULARLY CIGARETTES

[75] Inventors: Alessandro Minarelli, Bologna, Italy; Giuseppe Venturi, Richmond, Va.; Roberto Osti, Zola Predosa, Italy

[73] Assignee: G.D Societa'Per Azioni, Bologna, Italy

[21] Appl. No.: 196,710

[22] Filed: Feb. 15, 1994

[30] Foreign Application Priority Data

Feb. 23, 1993 [IT] Italy ..... BO93A060

[51] Int. Cl.[6] ..... A24F 15/06; A24F 15/20; B65D 85/10; B65D 25/04

[52] U.S. Cl. ..... 206/256; 206/259; 206/268; 206/273

[58] Field of Search ..... 206/242, 248, 206/256, 257, 258, 259, 261, 263, 265, 268, 271, 273

[56] References Cited

U.S. PATENT DOCUMENTS

| | | | |
|---|---|---|---|
| 1,108,006 | 8/1914 | Rey | 206/256 |
| 1,158,826 | 11/1915 | Mendelson | 206/273 X |
| 1,666,520 | 4/1928 | Whitney | 206/256 X |
| 1,684,381 | 9/1928 | Bahr | 206/256 X |
| 1,971,203 | 8/1934 | Soltys | 206/256 X |
| 3,092,301 | 6/1963 | Selle | 206/242 X |
| 3,899,125 | 8/1975 | Andrews et al. | 206/265 X |
| 4,207,976 | 6/1980 | Herman | 206/246 |
| 4,793,478 | 12/1988 | Tudor | 206/256 |
| 5,074,412 | 12/1991 | White | 206/256 |

FOREIGN PATENT DOCUMENTS

| | | |
|---|---|---|
| 501346 | 4/1920 | France . |
| 859201 | 12/1940 | France . |
| 292567 | 10/1928 | United Kingdom . |

*Primary Examiner*—Jacob K. Ackun
*Attorney, Agent, or Firm*—Marshall, O'Toole, Gerstein, Murray & Borun

[57] ABSTRACT

A rigid, hinged-lid packet, particularly for cigarettes, presenting an intermediate portion closed at opposite ends by two hinged lids and housing two opposite orderly groups of cigarettes, each accessible by opening a respective lid; the intermediate portion housing at least one substantially rigid reinforcing structure having a number of seats engaged by respective cigarettes.

9 Claims, 3 Drawing Sheets

RIGID HINGED-LID PACKET FOR TOBACCO PRODUCTS, PARTICULARLY CIGARETTES

BACKGROUND OF THE INVENTION

The present invention relates to a rigid, hinged-lid packet for tobacco products, particularly cigarettes.

Known rigid cigarette packets normally contain an orderly group of cigarettes accessible via an opening closed by a hinged lid, so that, when the lid is opened, the entire group is exposed to air, and the cigarettes, if not consumed within a short space of time, are subject to dehydration or other damage.

SUMMARY OF THE INVENTION

It is an object of the present invention to provide a rigid packet wherein the cigarettes are divided into two separately accessible groups.

It is a further object of the present invention to provide a packet wherein the cigarettes are maintained in a definite position until consumed.

According to the present invention, there is provided a rigid, hinged-lid packet for tobacco products, particularly cigarettes, characterized by the fact that it comprises an intermediate portion with two opposite open ends; two lids hinged to said intermediate portion and movable in relation to the same between two positions wherein respective said open ends are respectively closed and opened, said intermediate portion housing two opposite orderly groups of said products, and each said group being accessible by opening a respective said lid; and at least one substantially rigid reinforcing structure housed inside said intermediate portion and having a number of seats engaged by respective said products.

According to a first preferred embodiment of the above packet, this is a double packet comprising two single packets, each in turn comprising a cup-shaped container having a bottom wall at one end, and a hinged lid at the other; the two single packets being oppositely aligned with each other, contacting each other at said bottom walls, and housing respective said reinforcing structures; stable connecting means being provided for rendering said bottom walls integral with each other; and the two opposite integral containers defining said intermediate portion.

According to a further preferred embodiment of the above packet, said intermediate portion comprises a tubular element closed at opposite ends by said lids and housing one said reinforcing structure for two opposite said groups of products.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
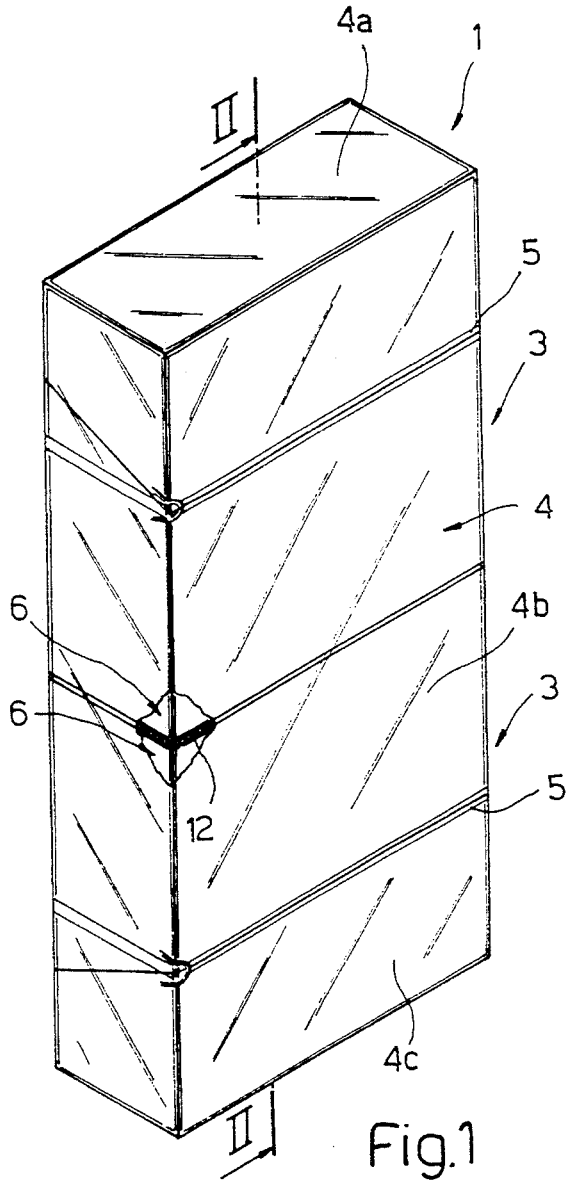
FIG. 1 shows a view in perspective of a first preferred embodiment of the packet according to the present invention.
Figure 2:
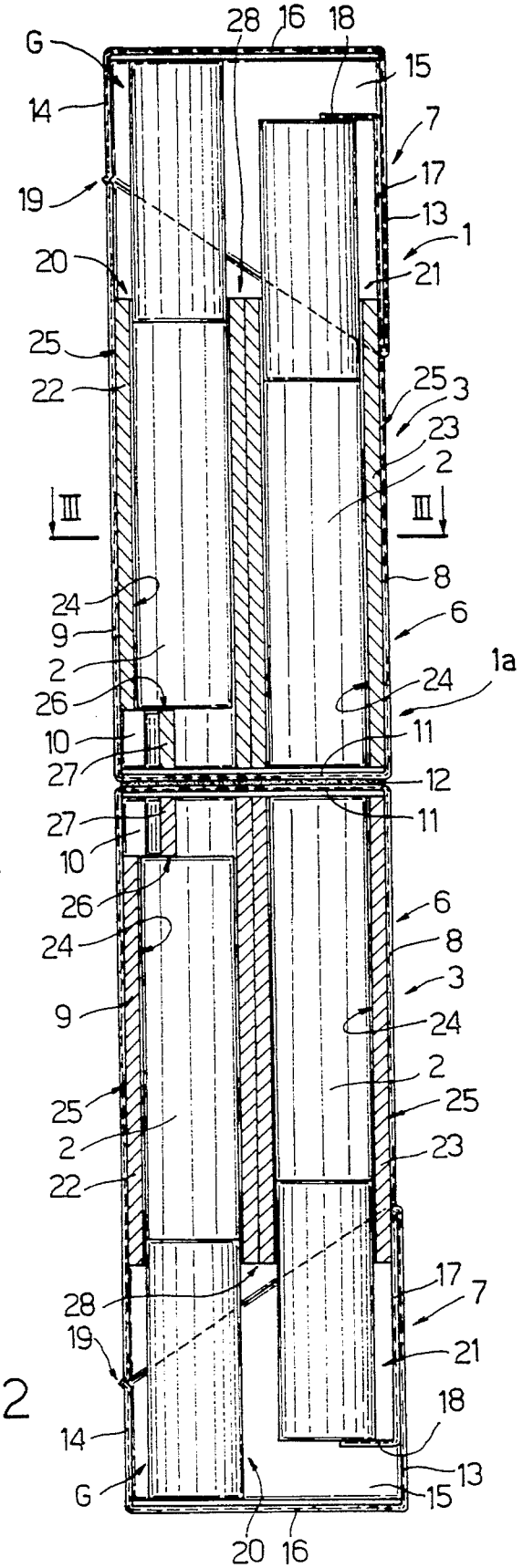
FIG. 2 shows, with parts removed for clarity, a larger-scale section along line II—II in FIG. 1.

Number 1 in FIGS. 1 and 2 indicates a double rigid packet for housing two orderly groups G of cigarettes 2, and defined by two single packets 3 joined by their bottom ends, and by a single wrapping 4 of transparent material divisible in three parts *4a, 4b, 4c* by means of two tear-off strips 5.

Figure 3:
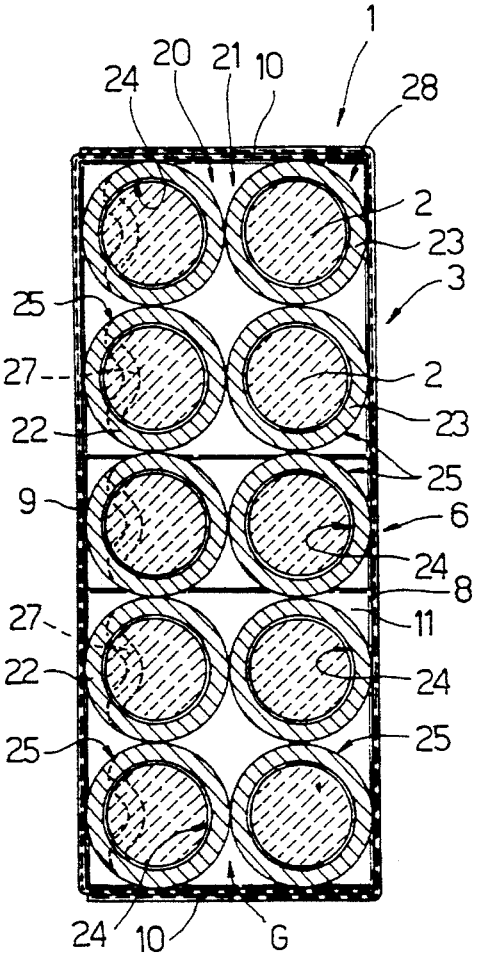
FIG. 3 shows, with parts removed for clarity, a larger-scale section along line III—III in FIG. 2.

As shown in FIGS. 2 and 3, each packet 3 comprises a cup-shaped container 6, and a cup-shaped lid 7 connected to container 6 so as to rotate between two positions wherein container 6 is respectively open and closed.

Container 6 presents a front wall 8 and a rear wall 9 parallel to and facing each other; two parallel lateral walls 10 perpendicular to walls 8 and 9; and a bottom wall 11 perpendicular to walls 8, 9 and 10. Wall 8 is shorter than wall 9, so that walls 10 are defined, at the opposite end to wall 11, by respective edges sloping towards wall 11 and wall 8.

As shown in FIG. 2, walls 11 of the two packets 3 are placed contacting each other so that front walls 8 of packets 3 are coplanar; and are made integral with each other via the interposition of a layer 12 of adhesive material, for connecting the two containers 6 which together define, in packet 1, an intermediate portion 1*a* housing the two groups G and the opposite ends of which are closed by respective lids 7.

Lid 7 of each packet 3 presents a front wall 13 and a rear wall 14 parallel to and facing each other; two parallel lateral walls 15 perpendicular to walls 13 and 14; and an end wall 16 perpendicular to walls 13, 14 and 15. Wall 13 presents an inner strengthening flap 17, the end portion of which is bent perpendicularly inwards of packet 3 to form a tab 18 parallel to and located a given distance from wall 16. Wall 14 presents a free edge connected by a hinge 19 to a free edge of wall 9, and is shorter than wall 13, so that walls 15 present respective free edges sloping towards wall 13.

Each packet 3 is completed inwards by a known substantially U-shaped collar (not shown) extending outwards through the open end of container 6 and engaging lid 7 when this is closed.

As shown in FIGS. 2 and 3, inside container 6 of each packet 3, cigarettes 2 are arranged in two parallel rows 20 and 21 between walls 8 and 9; and each cigarette 2 in one row 20, 21 is aligned, in a direction perpendicular to walls 8 and 9, with a corresponding cigarette 2 in the other row.

Cigarettes 2 in rows 20 and 21 are housed partially inside respective sleeves 22 and 23 preferably made of plastic material and made integral with the adjacent sleeves 22, 23, and preferably with the inner surface of respective container 6, either by friction or bonding. As shown in FIG. 2, each sleeve 22, 23 of each packet 3 presents a central hole defining a cylindrical seat 24 housing in sliding manner the end portion of a respective cigarette 2; and is defined externally by a surface 25 coaxial with respective seat 24. In the example embodiment shown, surface 25 is a cylindrical surface tangent to the surfaces 25 of adjacent sleeves 22 and 23, but may of course be replaced by any surface having a plane cross section inscribable in a square with sides equal in length to the diameter of surface 25, perpendicular to one another, and respectively parallel to walls 8, 9 and 10.

Sleeves 22 and 23 of each packet 3 are equal in length, shorter than cigarettes 2, and substantially the same length as wall 8, so that cigarettes 2 project outwards of the open end of container 6 of respective packet 3. More specifically, cigarettes 2 are shorter than respective packet 3, and cigarettes 2 in front row 21 substantially contacting wall 8 are arranged with one end contacting the inner surface of wall 11, and the other end contacting tab 18; while cigarettes 2 in rear row 20 substantially contacting wall 9 are arranged with one end substantially contacting the inner surface of wall 16, and the other end contacting a respective shoulder 26 formed by partially cutting respective sleeve 22 transversely, close to the end adjacent to wall 11, and pushing the cut portion inwards to form a curved portion 27 penetrating partly inside respective seat 24 and defining respective shoulder 26.

Using two connected packets 3 therefore enables access to one packet 3 at a time by tearing off respective strip 5 and opening respective lid 7, while the remaining unused part of packet 1 is left perfectly sealed. Moreover, sleeves 22, 23 provide for forming, inside each packet 3, a substantially rigid reinforcing structure 28 defined by respective sleeves 22, 23 and which provides for maintaining cigarettes 2 firmly in position inside respective packets 3. Sleeves 22, 23 also provide for preventing external stress on packets 3 during use, and particularly during storage, from being transmitted to cigarettes 2; for preventing direct contact of cigarettes 2 and hence the transmission of forces resulting in tobacco fallout; and, last but not least, for enabling cigarettes 2 in each packet 3 to be arranged in vertically offset rows for troublefree removal.

Figure 4:
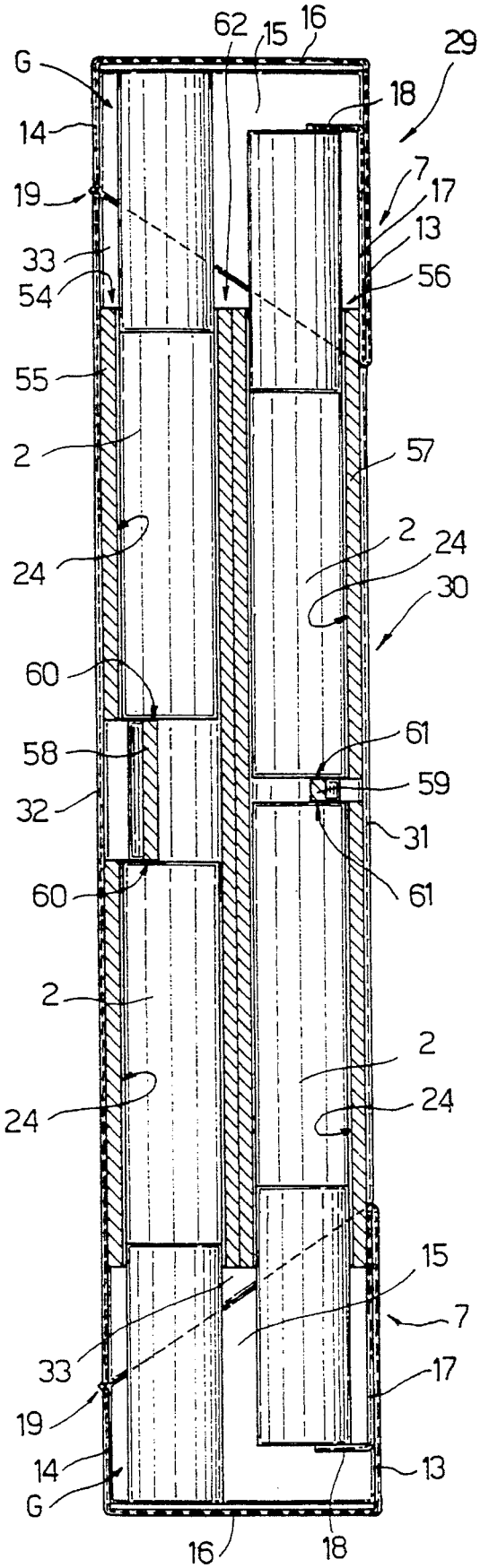
FIG. 4 shows the same section as in FIG. 2, of a second embodiment of the packet in FIGS. 1 to 3.
Figure 5:
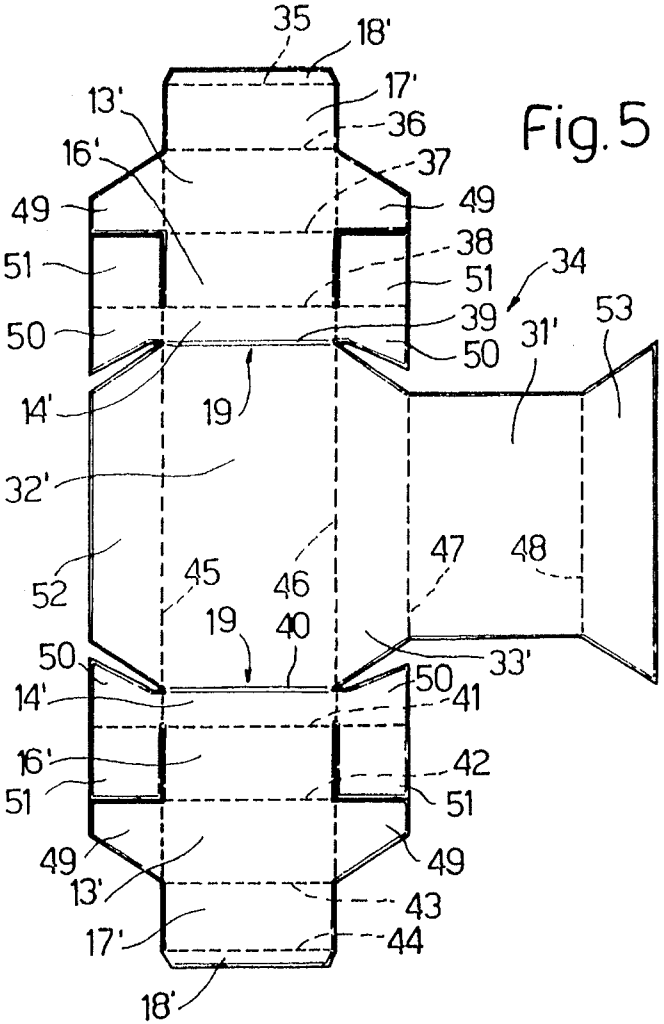
FIG. 5 shows a plan view of a detail in FIG. 4.

The embodiment shown in FIGS. 4 and 5 relates to a double packet 29 substantially similar to packet 1, and the corresponding component parts of which are indicated, wherever possible, using the same numbering system.

Packet 29 differs from packet 1 by presenting no walls 11; and the two containers 6, as opposed to being separate, are integral with each other and define a single intermediate tubular element 30 closed at opposite ends by two lids 7 with respective inner tabs 18, and which presents a front wall 31, a rear wall 32 parallel to wall 31, and two lateral walls 33 perpendicular to walls 31 and 32. Tubular element 30 and the two lids 7 are formed from a single flat blank 34, the component parts of which are indicated, wherever possible, using the same reference numbers, plus a (′), as for the corresponding component parts of packet 29.

As shown in FIG. 5, blank 34 presents a number of preformed transverse bend lines 35, 36, 37, 38, 39, 40, 41, 42, 43, 44, and four preformed longitudinal bend lines 45, 46, 47, 48.

Lines 39 and 40 define the two hinges 19, and, between lines 45 and 46 and together with the other transverse lines, define two end panels 18' for forming respective tabs 18; two panels 17' for forming respective flaps 17; two panels 13' for forming respective front walls 13 of respective lids 7; two panels 16' for forming respective end walls 16 of respective lids 7; two panels 14' for forming respective rear walls 14 of respective lids 7; and a first central panel 32' for forming rear wall 32 of tubular element 30, the front wall 31 of which is defined by a second central panel 31' located between lines 47 and 48 and to the side of panel 32'.

In each pair of panels 13' and 14', panel 13' presents a pair of first trapezoidal outer lateral tabs 49, and panel 14' a pair of second trapezoidal outer lateral tabs 50, which are folded squarely in relation to respective panel 13', 14' and placed one on top of the other to define the lateral walls 15 of respective lid 7. Tabs 50 also present respective axial appendixes 51 facing respective tabs 49 and which are folded squarely beneath respective panel 16' to form respective wall 16 of respective lid 7. Lines 46 and 47 define a panel 33' interposed between central panels 31' and 32' and designed to form one of lateral walls 33 of tubular element 30; while lines 45 and 48 respectively define, outwards of respective panels 32' and 31', two longitudinal tabs 52 and 53 which are folded squarely and placed one on top of the other to define the other of lateral walls 33.

Figure 6:
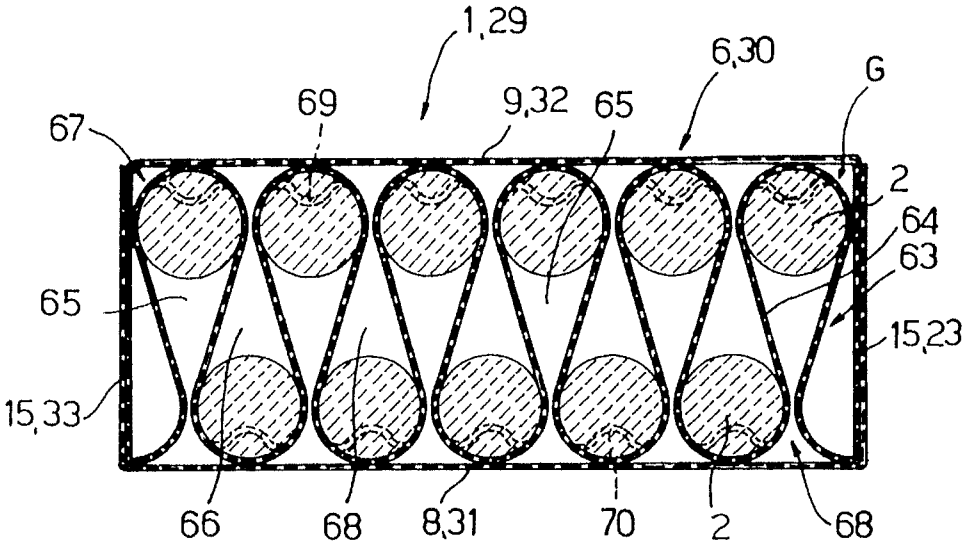
FIG. 6 shows the same section as in FIG. 3, of a variation of the packets in any of the above drawings.

As shown in FIG. 4, in packet 29, sleeves 22 and 23 of packet 1 are replaced by a rear row 54 of similar double sleeves 55, and by a front row 56 of similar double sleeves 57 of the same length as sleeves 55. Sleeves 55 and 57 present respective intermediate portions 58 and 59—the first longer than the second— which are folded inwards of respective sleeves 55 and 57 to define respective pairs of opposite shoulders 60 and 61, and provide for separating a respective pair of opposite, coaxial cigarettes 2. As in each packet 3 of packet 1, the greater length of portions 58 as compared with portions 59 provides, in packet 29, for axially offsetting the cigarettes 2 in each row housed inside sleeves 55 in relation to the corresponding cigarettes 2 housed inside sleeves 57. Sleeves 55 and 57 are joined by friction or bonding to form a reinforcing structure 62 which, like structure 28, may be replaced by a substantially rigid reinforcing structure 63 (FIG. 6) consisting of a strip 64 of sheet material folded substantially into a sinusoid, the curves of which define two series of offset pockets 65, 66 aligned into two rows 67, 68, and each designed to house a respective cigarette 2 (or pair of opposite cigarettes 2).

As with sleeves 22 and 55, strip 64 presents, at each pocket 65, a folded portion 69 for supporting respective cigarette 2. In the event strip 64 is of double width, equal to the length of sleeves 55 and 57, pockets 66 will also present respective folded portions 70 similar to portions 59.

We claim:

1. A rigid, hinged-lid packet for tobacco products, particularly cigarettes, comprising an intermediate portion with two opposite open ends, two lids hinged to said intermediate portion and movable in relation to the same between two positions wherein respective said open ends are respectively closed and opened, said intermediate portion housing two opposite orderly groups of said products, and each said group being accessible by opening a respective said lid;

and at least one substantially rigid reinforcing structure housed inside said intermediate portion and having a number of seats engaged by respective said products;

the reinforcing structure comprising a number of independent, substantially rigid sleeves, each having a central hole defining a respective said seat for at least one respective said product; said seats being arranged in a front row and a rear row inside said intermediate portion;

each seat in the rear row having inner supporting means for axially offsetting each respective product in relation to a corresponding product in the front row;

each said supporting means comprising a portion of said reinforcing structure, which is cut and folded inwards of the respective said seat.

2. A packet as claimed in claim 1 wherein said packet is a double packet comprising two single packets, each in turn comprising a cup-shaped container with a bottom wall at one end, and said hinged lid at the other end; the two single packets being oppositely aligned, contacting each other at said bottom walls, and housing respective said reinforcing structures; stable connecting means being provided for making said bottom walls integral with each other, the two opposite, integral containers defining said intermediate portion.

3. A packet as claimed in claim 1, wherein said intermediate portion comprises a tubular element closed at opposite ends by said lids and housing a single said reinforcing structure for two opposite said groups of products.

4. A packet as claimed in claim 2, wherein the sleeves are arranged in contact and integral with one another.

5. A packet as claimed in claim 4, wherein said sleeves are integral with said intermediate portion.

6. A packet as claimed in claim 4, wherein each sleeve is defined externally by a surface having a cross section ranging between a circle of a given diameter and a square circumscribing said circle.

7. A packet as claimed in claim 1, wherein said reinforcing structure comprises a strip of sheet material formed substantially into a sinusoid in turn comprising a number of curves defining two series of offset pockets; each pocket defining a respective said seat for at least one respective said product.

8. A packet as claimed in claim 1, wherein each said lid includes stop means for maintaining a given axial position of products housed in said front row.

9. A packet as claimed in claim 8, wherein each lid presents a front wall having an inner strengthening flap; an end portion of the strengthening flap being bent squarely and projecting inwards to define said stop means.

* * * * *